United States Patent [19]

Fuhrmann et al.

[11] Patent Number: 4,931,793

[45] Date of Patent: Jun. 5, 1990

[54] SYSTEM FOR PROVIDING A WARNING WHEN VEHICLES APPROACH A COMMON COLLISION POINT

[75] Inventors: Norbert Fuhrmann, Palm Beach Gardens; Nick Friedman, West Palm Beach, both of Fla.

[73] Assignee: Solitron Devices, Inc., Riviera Beach, Fla.

[21] Appl. No.: 214,444

[22] Filed: Jul. 1, 1988

[51] Int. Cl.[5] ..... G08G 1/16

[52] U.S. Cl. ..... 340/903; 455/99; 246/473.1

[58] Field of Search ..... 340/902, 903, 901, 539; 455/15, 99; 246/1 C, 124, 29 R, 167 D, 473.1

[56] References Cited

U.S. PATENT DOCUMENTS

| | | | |
|---|---|---|---|
| 3,365,572 | 1/1968 | Strauss | 340/903 X |
| 3,412,378 | 11/1968 | Thomas | 340/902 |
| 3,854,119 | 12/1974 | Friedman et al. | 340/902 |
| 4,238,778 | 12/1980 | Ohsumi | 340/903 |

OTHER PUBLICATIONS

Feasibility Study of In-Vehicle Warning Systems, D. D. Peterson, et al., May, 1975, Tracor Jitco, Inc.; Department of Transportation, HS-801 569, Contract No. DOT-HS-256-3-752.

*Primary Examiner*—Joseph A. Orsino
*Assistant Examiner*—Jeffery A. Hofsass
*Attorney, Agent, or Firm*—Staas & Halsey

[57] ABSTRACT

A system for providing a warning when at least two vehicles, first and second vehicles, are near a common collision point. The system includes closed loop verification between a first vehicle and a common collision point. The system includes a first transmitter for transmitting a first radio frequency signal, a first receiver for receiving the first radio frequency signal at the common collision point, a second transmitter for transmitting a second radio frequency signal from the common collision point to the first vehicle and to any approaching vehicles, a second receiver in a vehicle which can receive the second radio frequency signal and indicate that the first and second vehicles are near a common collision point, and a third receiver in the first vehicle for receiving the second radio frequency signal and for providing an indication that a closed loop between the first vehicle and the common collision point is functioning properly.

12 Claims, 1 Drawing Sheet

SYSTEM FOR PROVIDING A WARNING WHEN VEHICLES APPROACH A COMMON COLLISION POINT

BACKGROUND OF THE INVENTION

The present invention relates to warning systems for providing a warning when two vehicles are near a common collision point. For example, the present invention relates to a system for providing a warning when a vehicle and a train simultaneously are near a common railroad crossing.

Almost as long as railroad crossings have been in existence, efforts have been made to prevent vehicles from running into or being hit by trains at the railroad crossings. At least as early as the 1930's, efforts have been made to employ radio control devices to improve the safety of railroad crossings. Previous systems, however, were subject to false alarms. False alarms would be generated, for example, whenever a vehicle and a train were in proximity to each other without regard to them both being in proximity to a common railroad crossing. In addition, a false alarm would be generated when, for example, a vehicle received a radio frequency that was generated by a source other than safety equipment on the train. Such a stray or erroneous signal could be generated by another transmitter or could be radio frequency noise.

In addition, previous systems did not have the capability of closed loop verification. For example, an engineer on a train would not know if the train was actually transmitting the proper frequency and if equipment at a railroad crossing was operating properly. Without such verification, it is impossible to determine whether or not any vehicles approaching a railroad crossing could possibly be warned.

In addition to overcoming the technical drawbacks of prior systems, there is a significant economic need for a simple, economic and reliable railroad crossing warning device. A 1975 study prepared for the U.S. Department for Transportation entitled "Feasibility Study of In-Vehicle Warning System" (DOT HS-801 569) indicates that there are approximately 12,000 railroad crossing accidents annually. These accidents result in tremendous costs to society in terms of lost lives, medical payments and increased expenses for railroads.

SUMMARY OF THE INVENTION

It is an object of the present invention to provide a simple, inexpensive and reliable vehicle collision warning system.

It is another object of the present invention to provide a simple, inexpensive and reliable system for providing a warning when two vehicles are near a common collision point.

It is a further object of the present invention to provide a simple, inexpensive and reliable system for providing a warning when a vehicle and a train simultaneously are near a common railroad crossing.

It is still another object of the present invention to provide a simple, inexpensive and reliable vehicle warning system including a closed loop feed-back between a common collision point and a vehicle.

It is still a further object of the present invention to provide a simple, inexpensive and reliable vehicle warning system of the type described above that provides verification of the proper system functioning.

To achieve the above and other objects, the present invention provides a warning when a first vehicle and a second vehicle are near a common collision point. The first vehicle has an active state; for example, when the first vehicle is in motion. The system includes first transmitter means for transmitting a first radio frequency (hereinafter "r.f.") signal from the first vehicle in response to either the first vehicle being in the active state or a first control signal; warning means for receiving the first r.f. signal at the common collision point and for transmitting a second r.f. signal from the common collision point in response to receiving the first r.f signal; first receiving means for receiving the second r.f. signal at the first vehicle and for providing the first control signal in response to receiving the second r.f. signal; and second receiving means for receiving the second r.f. signal at the second vehicle and for providing an indication of receiving the second r.f. signal so as to provide a warning that the first vehicle and the second vehicle are near the common collision point.

DESCRIPTION OF THE PREFERRED EMBODIMENT

Figure 1:
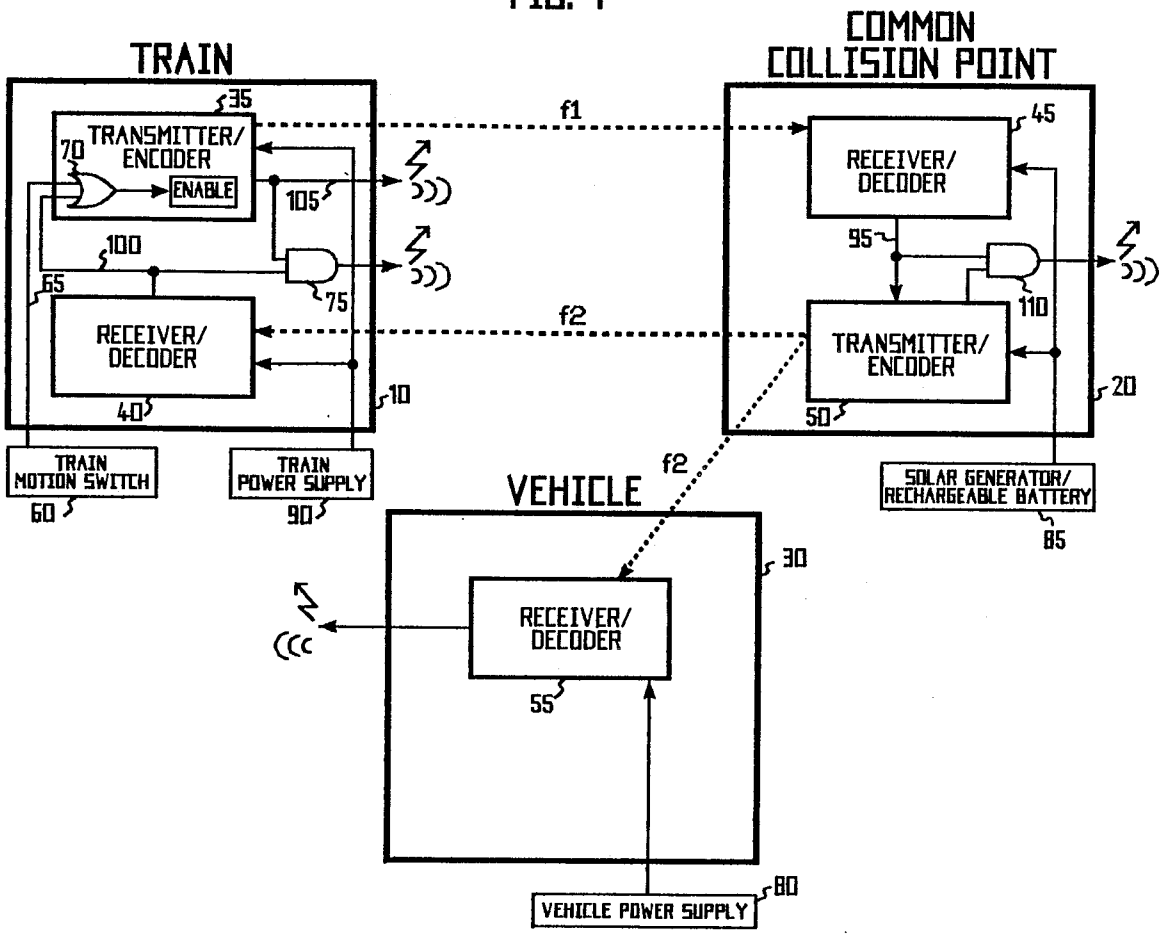
FIG. 1 is a block diagram of a system embodying the present invention.

Referring to FIG. 1, the present invention comprises a system for providing a vehicular collision warning that includes three major elements: (1) a transmitter/-receiver means 10 for transmitting a first r.f. signal from a first vehicle in response to either the first vehicle being in an active state or a first control signal 100, for receiving a second r.f. signal at the first vehicle and for providing the first control signal 100 in response to receiving the second r.f. signal; (2) a warning means 20 for receiving the first r.f. signal at a common collision point and for transmitting the second r.f. signal from the common collision point in response to receiving the first r.f. signal; and (3) a vehicle receiving means 30 for receiving the second r.f. signal at a second vehicle and for providing an indication of receiving the second r.f. signal so as to provide a warning that the first vehicle and the second vehicle are near the common collision point.

The transmitter/receiver means 10 comprises a transmitter/encoder 35 for transmitting the first r.f. signal from the first vehicle in response to at least one of the first vehicle being in an active state and the first control signal 100; and a receiver/decoder 40, positioned on the first vehicle, for receiving the second r.f. signal at the first vehicle and for providing the first control signal 100 in response to receiving the second r.f. signal. The transmitter/encoder 35 can comprise any common transmitter/receiver (encoder/decoder) circuit. By way of illustration only, the transmitter/encoder 35 can comprise National Semiconductor Part No. MM 53206 connected to drive any common r.f. generator. The receiver/decoder 40 can comprise any common r.f. demodulator driving a common encoder/decoder circuit such as the National Semiconductor Part No. MM 53206.

The warning means 20 comprises a receiver/decoder 45 for receiving the first r.f. signal and for providing a second control signal 95 in response to receiving the first r.f. signal and a transmitter/encoder 50 for transmitting the second r.f. signal in response to the second control signal 95, both located at a common collision point. The warning means 20 can optionally include an AND circuit 110 that is driven by the second control signal 95 and transmitter/encoder 50. The output of the AND circuit 110 can drive, for example, an annunciator and/or a visual indicator such as a LED or a strobe light. The output of the AND circuit 110 can also drive a low power computing device, and provide an independent means of verifying proper operation of the warning device 20. This physical indication of reception of the first r.f. signal at the common collision point also serves as a warning to vehicles not equipped with a receiver for receiving the second r.f. signal. The receiver/decoder 45 and transmitter/encoder 50 have structures respectively corresponding to the receiver/decoder 40 and transmitter/encoder 35.

The vehicle receiving means 30 comprises a receiver/decoder 55, located on a second vehicle, for receiving the second r.f. signal at the second vehicle and for providing an indication of receiving the second r.f. signal so as to provide a warning that the first vehicle and the second vehicle are near the common collision point. The receiver/decoder 55 can have the same structure as the receiver/decoder 40 and the receiver/decoder 45.

It will of course be recognized by those skilled in the art that the system of the present invention does not require the encoding/decoding capability. For example, the transmitter/encoder 35, receiver/decoder 40, receiver/decoder 45, transmitter/encoder 50 and receiver/decoder 55 can be simply r.f. transmitters and receivers. The encoding/decoding capability, however, provides the advantage of preventing false alarms due to reception of, for example, stray r.f. frequencies. For example, if the warning means 20 was subjected to a strong r.f. signal (not necessarily having the frequency f1), the second control signal 95 could be generated; thus, erroneously generating the second r.f. signal. In such circumstances, the encoding/decoding capability would prevent the erroneous transmission of the second r.f. signal.

Mounted on the first vehicle is a detector 60 for detecting when the first vehicle is in an active state; for example, when the first vehicle is moving. The detector 60 can comprise a motion detector that detects when the first vehicle (e.g. a train) is in motion. When the detector 60 detects motion of the first vehicle, the detector provides a motion signal to a signal line 65.

The motion signal indicates that the first vehicle is in an active state and causes the transmitter/encoder 35 to transmit a first r.f. signal, f1. In addition, the motion signal can also activate the receiver/decoder 40, enabling the receiver/decoder 40 to receive a second r.f. signal f2; rather than having the receiver powered all of the time by the train power supply 90 as shown in FIG. 1. The transmitter/encoder 35 can include an indication device such as an LED for indicating that the transmitter/encoder 35 is actually transmitting the first r.f. signal f1. A first control signal 100 or feedback signal also activates the transmitter/encoder 35. Thus, the transmitter/encoder 35 transmits the first r.f. signal f1 when either the first vehicle is in an active state or the first control signal 100 is present.

The warning means 20 includes receiver/decoder 45 which can only receive the first r.f. signal f1. Upon receiving the first r.f. signal, the receiver/decoder 45 provides a second control signal 95 or reception signal that activates the transmitter/encoder 50. The transmitter/encoder means 50 transmits a frequency f2 in response to receiving the second control signal/reception signal 95. The second r.f. signal f2 is transmitted to both the receiver/decoder 40 and the receiver/decoder 55 that is positioned within the vehicle receiving means 30 on the second vehicle. The receiver/decoder 40 and the receiver/decoder 55 can only receive the second r.f. signal f2.

When the receiver/decoder 40 or train receiver means, receives the second r.f. signal f2, the receiver/decoder 40 generates the first control signal or feedback signal 100. The first control signal 100 ensures that the transmitter/encoder 35 continuously transmits the first r.f. signal f1 regardless of whether or not the first vehicle is in an active state.

The transmitter/receiver means 10 includes an OR circuit 70 and a verification means 75. The OR circuit 70 receives the motion signal 65 and the first control signal 100 and ensures that the transmitter/encoder 35 transmits the first r.f. signal f1 in response to either the first vehicle being in the active state as indicated by the motion signal on line 65, or the first control signal/feedback signal 100.

The verification means 75 includes an AND circuit that receives the first control signal 100 and a signal 105 responsive to the first r.f. signal f1. The signal 105 can physically indicate transmission of the first r.f. signal f1 by, for example, driving an annunciator and/or a visual indicator such as an LED. The output of the AND circuit, and thus the verification means 75, indicates that the transmitter/encoder 35, the warning means 20 and the receiver/decoder 40 are operating properly. More particularly, when the verification means 75 (e.g. the AND circuit) indicates that both the feedback signal 100 and the first r.f. signal f1 are present, the output of the verification means 75 provides closed loop verification that the transmitter/encoder 35 is transmitting the first r f. signal f1, the receiver/decoder 45 is properly receiving the first r.f. signal f1, the transmitter/encoder 50 is receiving the second control signal/reception signal 95 and in response thereto is transmitting the second r.f. signal f2, and that the receiver/decoder 40 is properly receiving the second r.f. signal f2 and in response thereto generating the feedback signal 100. The output of the verification means 75 can drive, for example, an annunciator and/or a visual indicator such as an LED. Alternatively, the output of the verification means 75 can drive a data recorder or any other computing device.

Thus, a system in accordance with the present invention is capable of verifying that the transmitter/receiver means 10 located on the first vehicle and the warning means 20 are operating properly. Such closed loop verification of proper system operation can be recorded on, for example, a data recorder located on the first vehicle. This would then provide a positive indication that the second r.f. signal f2 was being transmitted to nearby vehicles that may contain a vehicle receiving means 30 shown in FIG. 1.

In a preferred embodiment of the present invention, the transmitter/encoder 35 transmits the first r.f. signal f1 so that the signal f1 has a frequency in the range of, for example, 100–200 MHz. The first r.f. signal f1 preferably has a power sufficient for the first r.f. signal f1 to be received by the receiver/decoder 45. This power would enable the first r.f. signal to have a range of, for example, one mile which is a typical length of a long freight train.

The respective radiating patterns of the transmitter-/encoder 35 and transmitter/encoder 50 can be adjusted as desired. In one embodiment of the present invention, the radiating pattern would be, for example, approximately equidistant in all directions about the respective transmitters. Alternatively, the transmitter/encoder 35 would have a radiation pattern that is primarily oriented towards the rear of the train, providing sufficient radiation pattern in front of the train so that the warning means 20 receives the first r.f. signal f1 for a minimum time (e.g., 45 sec.) before the train reaches the common collision point or danger area. In addition, if a train is driven by engines on either end of the train, then the transmitters could transmit, for example, approximately ½ mile each; thus, covering the full length of the train with only half of the power needed for a single transmitter.

In a preferred embodiment of the present invention, the receiver/decoder 55 is positioned on a vehicle or a car, and is powered by a vehicle power supply 80. Because the receiver/decoder 55 can only receive the second r.f. signal f2 transmitted from the transmitter-/encoder 50 located at the common collision point, the system of the present invention is not subjected to false alarms when the car is travelling alongside or near a train, but not near a warning means 20. Consequently, only when the transmitter/receiving means 10 positioned on a first vehicle and the receiver/decoder 55 positioned on a car are near the warning means 20 will the vehicle receiving means 30 provide a warning that the first vehicle and the car are near a common collision point. Under such circumstances, the vehicle receiving means 30 provides a warning indication which can comprise, for example, illuminating a light and activating an annunciator. The vehicle receiving means 30 could also disable the car audio system so as to maximize the attention given to the warning provided by the vehicle receiving means 30.

In a preferred embodiment of the present invention, the warning means 20 is embodied in low power circuitry, such as low power bipolar or CMOS, and is powered by a solar generator/rechargeable battery pack 85. Depending upon the amount of time the warning means 20 is in use, it is estimated that with a relatively short exposure of the solar generator 85 to sunlight, the warning means 20 can be operational for a relatively long period of time.

The above discusses the present invention as embodied in a system for providing a warning when a train and a vehicle are near a railroad crossing. This discussion is not intended to limit the present invention to the particular embodiment employing, for example, cars and trains. Instead, it will be recognized by those skilled in the art that the present invention can be employed in a system for any type of vehicle wherein a warning is issued when at least two vehicles approach a common collision point.

What is claimed is:

1. A system for providing a warning when a first vehicle and a second vehicle are near a common collision point, the first vehicle having an active state, said system comprising:

first transmitter means for transmitting a first radio frequency signal from the first vehicle in response to either the first vehicle being in the active state or a first control signal;

warning means for receiving said first radio frequency signal at the common collision point and for transmitting a second radio frequency signal from the common collision point in response to receiving said first radio frequency signal;

first receiving means for receiving said second radio frequency signal at the first vehicle and for providing said first control signal in response to receiving said second radio frequency signal; and second receiving means for receiving said second radio frequency signal at the second vehicle and for providing an indication of receiving said second radio frequency signal so as to provide a warning that the first vehicle and the second vehicle are near the common collision point.

2. A system according to claim 1, wherein said warning means comprises:

third receiving means for receiving said first radio frequency signal and for providing a second control signal in response to receiving said first radio frequency signal; and second transmitter means for transmitting said second radio frequency signal in response to said second control signal.

3. A system according to claim 2, wherein said first transmitter means includes verification means for indicating proper operation of said first transmitter means, said warning means, and said second receiving means, in response to said first radio frequency signal and said first control signal.

4. A system according to claim 3, wherein said first transmitter means includes means for physically indicating transmission of said first radio frequency signal.

5. A system according to claim 3, wherein said first transmitter means includes means for encoding said first radio frequency signal, and wherein said third receiving means includes decoder means for decoding the encoded first radio frequency signal.

6. A system according to claim 2, wherein said second transmitter means includes encoder means for encoding said second radio frequency signal, and wherein each of said first and second receiving means includes means for decoding the encoded second radio frequency signal.

7. A system according to claim 3, wherein said second transmitter means includes encoder means for encoding said second radio frequency signal, and wherein each of said first and second receiving means includes means for decoding the encoded second radio frequency signal.

8. A system according to claim 5, wherein said second transmitter means includes encoder means for encoding said second radio frequency signal, and wherein each of said first and second receiving means includes means for decoding the encoded second radio frequency signal.

9. A system for providing a warning when a vehicle and a train are near a railroad crossing, the train having a detector for detecting motion of the train and for providing a motion signal in response to said motion detection, said system comprising:

train transmitter means for transmitting a first radio frequency signal from the train in response to at least one of the motion signal and a feedback signal;

crossing receiver means for receiving said first radio frequency signal at the crossing and for providing a reception signal based on receiving said first radio frequency signal;

crossing transmitter means for transmitting a second radio frequency signal from the crossing in response to said reception signal;

train receiver means for receiving said second radio frequency signal at the train and for providing said feedback signal in response to receiving said second radio frequency signal;

verification means for detecting transmission of said first radio frequency signal and for indicating proper transmission of said first radio frequency signal, proper reception of said first radio frequency signal by said crossing receiver means, proper transmission of said second radio frequency signal by said crossing transmitter means and proper reception of said second radio frequency signal by said train receiving means, in response to said detecting of transmission of said first radio frequency signal and said feedback signal; and vehicle receiving means for receiving said second radio frequency signal at the vehicle and for providing a warning that the train and the vehicle are near the crossing.

10. A system according to claim 9, wherein said train transmitter means includes means for encoding said first radio frequency signal, and wherein said crossing receiver means includes means for decoding the encoded first radio frequency signal.

11. A system according to claim 9, wherein said crossing transmitter means includes means for encoding said second radio frequency signal, and wherein said train receiver means and said vehicle receiving means include means for decoding the encoded second radio frequency signal.

12. A system according to claim 10, wherein said crossing transmitter means includes means for encoding said second radio frequency signal, and wherein said train receiver means and said vehicle receiving means include means for decoding the encoded second radio frequency signal.

* * * * *